US010023334B2

(12) United States Patent
Schwartz et al.

(10) Patent No.: US 10,023,334 B2
(45) Date of Patent: Jul. 17, 2018

(54) FULL MOTION WRAPPING APPARATUS

(71) Applicants: Marvin B. Schwartz, Lima, OH (US); Joseph V. Piper, Lima, OH (US)

(72) Inventors: Marvin B. Schwartz, Lima, OH (US); Joseph V. Piper, Lima, OH (US)

( * ) Notice: Subject to any disclaimer, the term of this patent is extended or adjusted under 35 U.S.C. 154(b) by 537 days.

(21) Appl. No.: 14/660,314

(22) Filed: Mar. 17, 2015

(65) Prior Publication Data

US 2015/0259087 A1 Sep. 17, 2015

Related U.S. Application Data

(60) Provisional application No. 61/953,978, filed on Mar. 17, 2014.

(51) Int. Cl.

| | |
|---|---|
| ***B65B 11/02*** | (2006.01) |
| ***B65H 81/06*** | (2006.01) |
| ***B65H 81/08*** | (2006.01) |
| ***B65H 81/00*** | (2006.01) |
| ***B65B 19/34*** | (2006.01) |
| ***B65B 59/00*** | (2006.01) |
| ***B65B 61/28*** | (2006.01) |

(52) U.S. Cl.

CPC ..... *B65B 11/025* (2013.01); *B65B 19/34* (2013.01); *B65B 59/005* (2013.01); *B65B 61/28* (2013.01); *B65H 81/00* (2013.01); *B65H 81/06* (2013.01); *B65H 81/08* (2013.01)

(58) Field of Classification Search

CPC ..... B65B 11/025; B65B 19/34; B65B 45/00; B65B 61/28; B65B 51/00; B65B 51/10; B65B 51/32; B65B 27/10; B65H 81/00; B65H 81/06; B65H 81/08; B65G 1/0442; B65G 1/026; B65G 19/30; B65G 19/303; B65G 19/306; B65G 25/00; B65G 25/08; B61H 81/00; B61H 81/06; B61H 81/08

USPC .... 53/556, 566, 218, 230; 414/745.1, 745.5, 414/746.4, 746.5, 746.7

See application file for complete search history.

(56) References Cited

U.S. PATENT DOCUMENTS

| | | | | |
|---|---|---|---|---|
| 1,583,486 A * | 5/1926 | Paige | ..... | B22D 13/10 164/344 |
| 1,777,089 A * | 9/1930 | Jansen | ..... | B65H 81/08 118/DIG. 11 |
| 1,777,095 A * | 9/1930 | Kramer | ..... | B65H 81/08 242/441.2 |
| 1,876,760 A * | 9/1932 | Rosener | ..... | B65H 81/08 118/DIG. 11 |
| 1,880,771 A * | 10/1932 | Burton | ..... | B65H 81/08 242/441.3 |

(Continued)

FOREIGN PATENT DOCUMENTS

WO 1996036535 11/1996

*Primary Examiner* — Hemant M Desai
*Assistant Examiner* — Eduardo R Ferrero
(74) *Attorney, Agent, or Firm* — Jacob M. Ward; Ward Law Office LLC

(57) ABSTRACT

A full motion wrapping apparatus includes a wrapper unit and a product support unit. The wrapper unit is configured for stretch wrapping a product. The product support unit includes a plurality of supports. The supports are movably disposed in, on or around a track with the wrapper unit. The wrapper unit may be positioned between corresponding pairs of the supports. The product support unit permits the stretch wrapping of the product while the product remains in a substantially stationary position.

12 Claims, 7 Drawing Sheets

(56) References Cited

U.S. PATENT DOCUMENTS 1,883,401 A * 10/1932 Rolfs ..... B65H 81/08 156/428
1,917,197 A * 7/1933 Rolfs ..... B65H 81/08 156/392
1,928,811 A * 10/1933 Burns ..... B21B 39/14 144/136.7
1,990,237 A * 2/1935 Lloyd ..... B65H 81/08 242/448
2,027,704 A 1/1936 Rosener
2,166,608 A * 7/1939 Postlewaite ..... B05C 13/02 100/214
2,279,340 A * 4/1942 Postlewaite ..... B05C 13/02 104/32.1
2,681,136 A * 6/1954 Ipsen ..... B65G 25/08 104/162
2,692,565 A * 10/1954 Cummings ..... B65H 81/08 104/236
2,842,272 A * 7/1958 Folks ..... B05C 13/00 118/500
2,880,844 A * 4/1959 Vogeli ..... B21B 43/00 198/463.5
3,580,461 A * 5/1971 Dobell ..... B21C 37/12 219/62
3,618,741 A * 11/1971 Berndt ..... B23Q 7/106 198/463.5
3,956,982 A * 5/1976 Hill ..... B65B 27/10 100/212
4,002,248 A * 1/1977 Moller ..... B65G 1/0442 414/745.1
4,062,456 A * 12/1977 Birdwell ..... B65G 1/0442 414/433
4,067,174 A 1/1978 Goldstein
4,142,644 A * 3/1979 Stoltz ..... B05B 13/0235 414/431
RE30,369 E * 8/1980 Wilson ..... B29C 63/105 156/392
4,221,534 A * 9/1980 Rethy ..... B23P 19/022 221/71
4,298,309 A * 11/1981 Stoltz ..... B05B 13/0235 105/238.1
4,545,182 A 10/1985 McDowell, Jr.
4,850,177 A 7/1989 Kaczkowski et al.
4,856,720 A * 8/1989 Deregibus ..... B29C 53/8008 156/429
5,417,786 A * 5/1995 Denman ..... B29C 63/105 156/187
5,623,808 A 4/1997 Franklin et al.
5,966,904 A * 10/1999 Peters ..... B65B 25/148 53/211
6,032,436 A * 3/2000 Hart ..... B65B 11/025 53/399
6,106,219 A * 8/2000 Newsome ..... B65H 29/26 198/468.1
6,267,544 B1 * 7/2001 Neville ..... B27B 29/00 144/242.1
6,520,445 B2 2/2003 Araujo
6,568,895 B2 * 5/2003 Dumenil ..... B41F 17/20 198/468.1
6,729,106 B2 5/2004 Wiley
6,896,019 B2 * 5/2005 Achard ..... B23Q 1/621 144/245.1
7,604,134 B2 * 10/2009 Lichinchi ..... B60P 1/5471 104/126
7,721,871 B2 * 5/2010 Takano ..... B61B 13/127 198/346.2
8,453,423 B2 6/2013 Bauer
8,938,939 B2 1/2015 Roche
2006/0213155 A1 * 9/2006 Forni ..... B65B 11/025 53/588
2012/0138183 A1 * 6/2012 Espinasse ..... B21C 37/12 138/33

* cited by examiner

FULL MOTION WRAPPING APPARATUS

CROSS-REFERENCE TO RELATED APPLICATIONS

This application claims the benefit of U.S. Provisional Application No. 61/953,978, filed on Mar. 17, 2014. The entire disclosure of the above application is hereby incorporated herein by reference.

FIELD

The present invention relates to packaging and, more particularly, to an apparatus for stretch wrapping and packaging products.

BACKGROUND

Stretch wrap or stretch film is a highly elastic plastic film that is wrapped around items. The elastic recovery keeps the items tightly bound. It is frequently used to unitize pallet loads, but may also be used for bundling smaller items.

Known types of stretch film include bundling stretch film, hand stretch film, extended core stretch film, machine stretch film and static dissipative film.

Categories of stretch wrappers generally include manual (or hand) wrappers, rotary arm wrappers, semi-automatic wrappers, and automatic wrappers. Sub-categories of manual wrappers include extended core, mechanical brake, and pole wrappers. With extended core systems, an extension of the film's core serves as a handle for wrapping. This type of wrapper offers little stretch control and is hard on hands. With mechanical brake systems, a simple structure supports a film roll and a mechanical brake system provides resistance creating stretch of the film. Pole wrappers are similar to the mechanical brake systems, but the roll and brake are at the end of an extended pole. This creates an ergonomic design that eliminates the need to bend to wrap the bottoms of loads and strain to reach the tops of loads.

In rotary arm wrapper systems, the load remains still while a rotating arm turns around it, thus wrapping the load. This system is used for light loads, or for speeds which would otherwise cause the load to topple due to high rotation speeds.

Known types of semi-automatic wrappers include turntable wrappers and orbital wrappers. With turntable wrappers, the load to be wrapped sits on a turntable that spins the load relative to the film roll. The film roll is generally housed in a carriage which can move up and down a fixed "mast". Stretch is achieved by rotating the load at a faster rate than the film is fed. With orbital wrappers, the film is housed in a carriage on a vertical ring. The load is then fed horizontally through the eye of the rotating ring, applying film to the load. A variation of the orbital stretch wrapper is a horizontal ring system, in which the load remains still while a horizontal ring is rotated around the load and moves up and down vertically relative to the load, similar to a rotary arm stretch wrapper.

Automatic wrappers are generally a variant of the semi-automatic wrapper systems. Automatic wrappers include a conveyor system to automatically load the wrapping machine, and automatic systems to apply, seal, and cut the film.

There is a continuing need for a horizontal stretch wrapping apparatus and method that does not require the use of a conveyor system, particularly where space is limited.

Desirably, a product to be packaged by stretch wrapping is substantially stationary during the stretch wrapping process.

SUMMARY

In concordance with the instant disclosure, a horizontal stretch wrapping apparatus and method that does not require the use of a conveyor system, and which permits a product to be packaged by stretch wrapping while substantially stationary during the stretch wrapping process, is surprisingly discovered.

In one embodiment, a full motion wrapping apparatus includes a wrapper unit and a product support unit. The wrapper unit is configured for stretch wrapping a product. The product support unit includes a plurality of supports. The supports are disposed adjacent, i.e., either in, on, or around, a track on which the wrapper unit moves. The wrapper unit may be positioned between a pair of connected supports. The product support unit permits the stretch wrapping of the product while the product remains in a substantially stationary position.

In another embodiment, the connected pair of supports of the product support unit includes a first support and a second support. The first support and the second support are connected by at least one horizontal rail that is disposed beneath the wrapper unit. Each of the supports also has a top side and bottom side. The top side has a roller for receiving the product, and the bottom side has a freely rotating wheel for guiding the support in, on, or around the track. The wrapper unit is positioned between the connected pair of supports. The first support is disposed between the wrapper unit and the first end of the track. The second support is disposed between the wrapper unit and the second end of the track. Each of the first support and the second support move in tandem as the one of the first support and the second support is caused to move by contact with the wrapper unit.

In an alternative embodiment, each of the supports is instead connected to an actuator. The actuator is configured to selectively pivot the supports from a position for supporting the product, to a position permitting the wrapper unit to move over the support.

In an exemplary embodiment, a full motion wrapping apparatus according to the present disclosure wraps or packages products by means of traversing in line with the product while the packaging orbits the material by means of a rotation device. The apparatus comprises mainly the wrapper and the product supports.

The product may be supported by movable supports with rollers. These supports move on tracks with the wrapper, but they can move independent of each other as well. There are several supports, each of which has a corresponding support on the opposite side of the wrapper. The wrapper is positioned between the pairs of connected supports.

The length of the product to be packaged determines the positioning of the wrapper. The supports are automatically positioned by the wrapper, but can be custom positioned if desired. The product is placed on the supports on one side of the wrapper.

The apparatus is operated with a control that allows a user to select a direction of travel for the wrapper, a control that moves the wrapper according to the direction that is set, another control that operates the orbiter (packaging), and another control that operates traversing and orbiting simultaneously.

As the wrapper moves from one end of the product to the other end, the supports that hold the product become bundled together in front of the wrapper. As this occurs, the corresponding supports on the other side of the wrapper are moved automatically so that the product remains supported at all times.

In a particular embodiment, the supports may be about 48" wide, 30" tall, and 2" thick with track rollers on the bottom and conveyor rollers on the top. The wrapper is about 70" wide, 70" tall, and 32" deep. It houses the controls, control box, drive mechanism (electric motor and gearbox) for traversing. It also houses the drive mechanism (electric motor and ratio reduction pulleys) for the orbital wheel. The orbital wheel is about 56" in diameter and is held in place by rollers, one of which is a drive roller. The orbiter also holds the stretch wrap on rods with adjustable tension to control dispensing of the stretch wrap material.

BRIEF DESCRIPTION OF THE DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
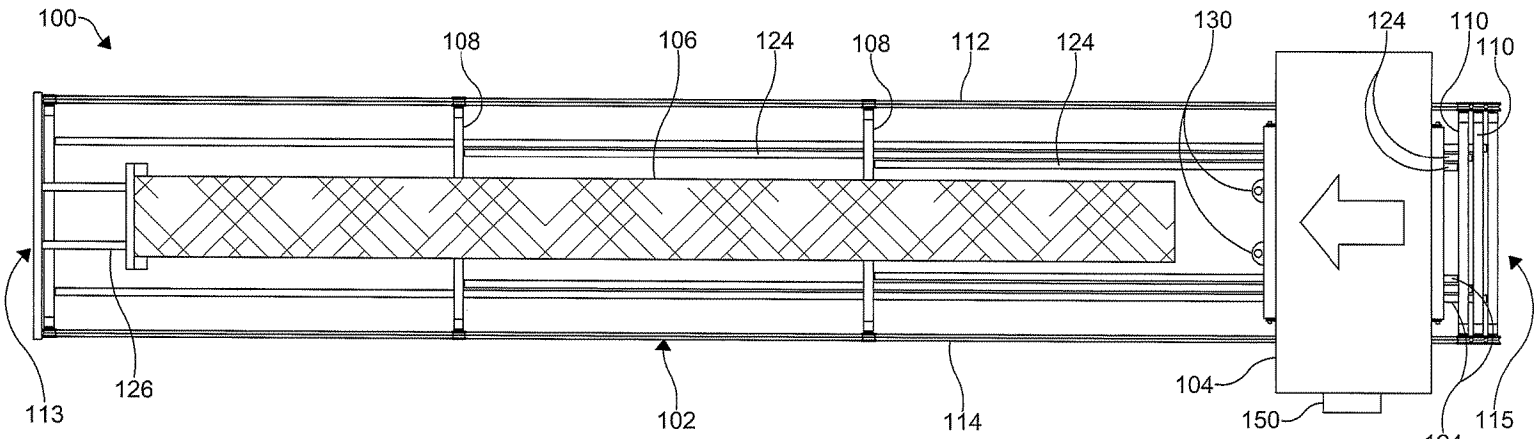
FIGS. 1-5 are schematic top plan views of a full motion wrapping apparatus according to one embodiment of the present disclosure, showing a sequential operation of the full motion wrapping apparatus for packaging a product in limited space, with arrows on a wrapper unit showing a direction of movement of the wrapper unit in the full motion wrapping apparatus.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical unless otherwise disclosed.

FIGS. 1-12 show a full motion wrapping apparatus 100 according to various embodiments of the present disclosure. The apparatus 100 has a product support unit 102 and a wrapper unit 104. The product support unit 102 is configured to support and maintain a product 106 in a substantially stationary position during a stretch wrapping of the product 106. The wrapper unit 104 is movable along the product support unit 102 and is configured to stretch wrap the product 106 while it is maintained in the substantially stationary position on the product support unit 102.

Although the apparatus 100 of the present disclosure has been found to be particularly useful with the wrapping and packaging of metal sheet products 106, such as stacks of metal siding for buildings, it should be understood that the apparatus 100 may also be used with any other product 106, as desired. The product 106 may also include standing seam roofing materials, vinyl siding, pipes, stock metal rods, and lumber, as non-limiting examples.

As shown in FIGS. 1-5, the product support unit 102 has a plurality of supports 108, 110 and a track 112, 114. The track 112, 114 constrains a movement of the supports 108, 110 in the product support unit 102. For example, as depicted in FIGS. 1-5, the track 112, 114 may have a first end 113 and a second end 115 between which the supports 108, 110 are movably disposed. It should be understood that the track 112, 114 may also be adjustable in length, so as to permit the packaging or wrapping of the product 106 of different lengths. The track 112, 114 may also have a first track rail 112 and a spaced apart second track rail 114, with each of the supports 108, 110 guided by both of the track rails 112, 114. However, other embodiments having a single track 112, 114, or more than two tracks 112, 114, for guiding the movable supports 108, 110 are also within the scope of the present disclosure.

It should be appreciated that the supports 108, 110 of the product support unit 102 may be disposed adjacent to the track 112, 114, in order for the track 112, 114 to function as a guide for the supports 108, 110 as they move. In a particular example, the supports 108, 110 may be disposed in or on the track 112, 114, so that the supports 108, 110 are guided by the track 112, 114 and can freely be moved back and forth along the track 112, 114. In other examples, the supports 108, 110 may be disposed around the track 112, 114 so that the track 112, 114 guides the supports 108, 110, which can in turn be freely moved back and forth along the track 112, 114. Other suitable means for movably disposing the supports 108, 110 relative to the track 112, 114 may also be selected by one of ordinary skill in the art, as desired.

Figure 8:
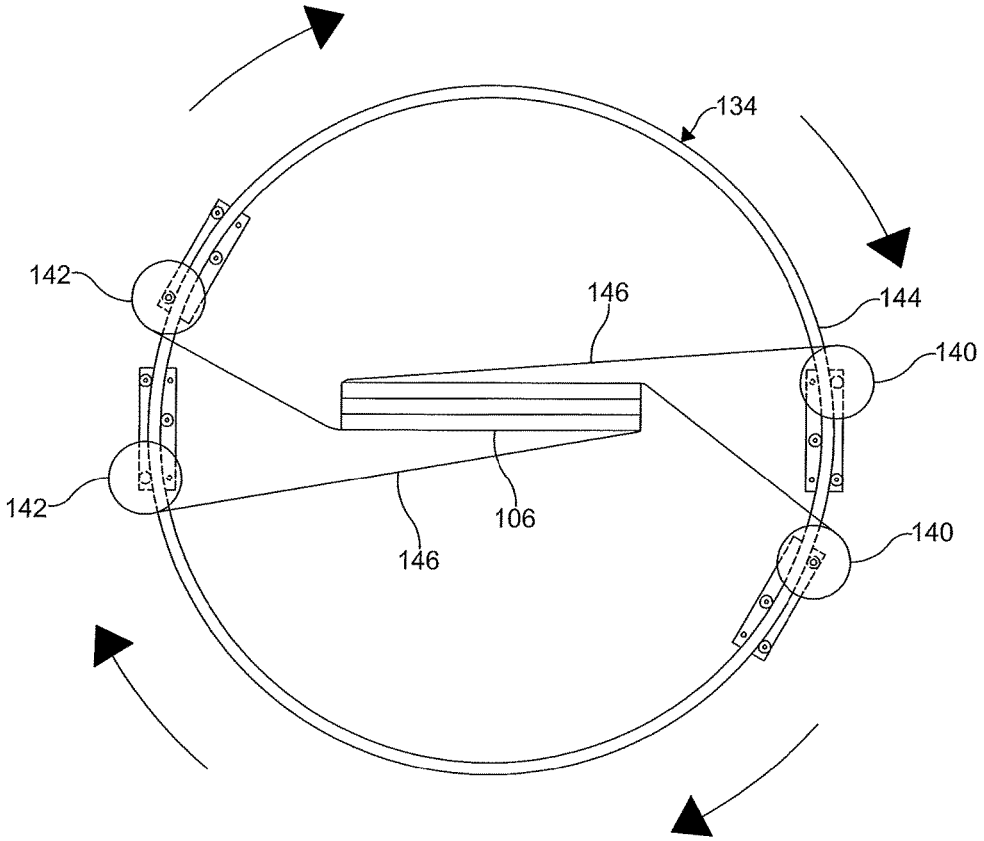
FIG. 8 is a front elevational view of an orbital wheel or orbiter of the wrapper unit illustrated in FIGS. 1-7, showing a wrapping of a product disposed within the orbital wheel.
Figure 9:
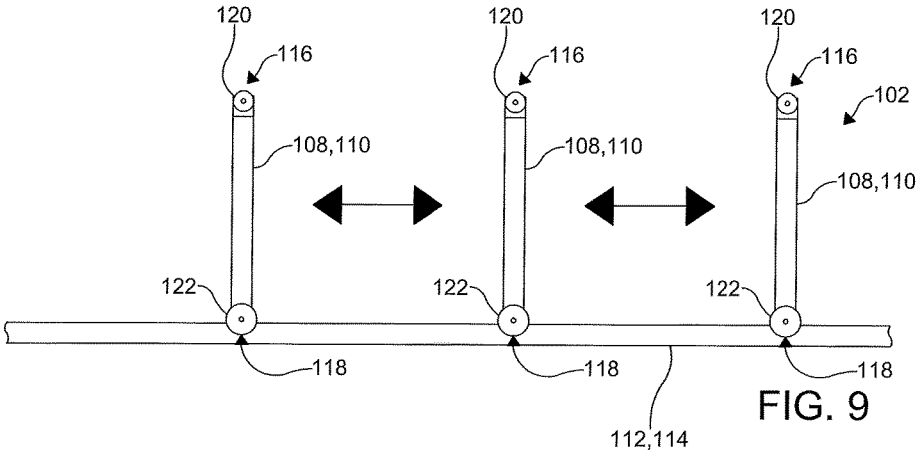
FIG. 9 is a fragmentary side elevational view of the product support unit illustrated in FIGS. 1-7, showing by the arrows the individual product supports being laterally movable relative to each other on the track to facilitate movement of the wrapper unit on the same track.

Referring to FIG. 9, each of the supports 108, 110 of the product support unit 102 has a top side 116 and a bottom side 118. The top side 116 of the support 108,110 is configured to receive the product 106. The bottom side 118 of the support 108, 110 is configured to be guided by the track 112, 114. In a particular example, the top side 116 of the support 108, 110 has a roller 120 that can freely rotate on the top side 116. Although the roller 120 is shown oriented substantially horizontal in FIGS. 1-8, it should be appreciated that the roller 120 may also be tilted in certain embodiments, as desired. The tilting of the roller 120 may accommodate different types of the product 106, such as standing seam roofing materials, pipes, bars, etc. The supports 108, 110 may have a measurement device that shows a degree of tilt of the roller 120.

The product 106 is thereby permitted to be easily transported from one end of the product support unit 102 to another end of the product support unit 102. The roller 120 may have one or more collars disposed thereon which prevent the product 106 from sliding laterally off of the roller 120 during the wrapping operation. The roller 120 may have a rubberized coating, for example, to minimize opportunities for scratching or otherwise damaging the product 106 as it is transported along the supports 108, 110. The rubberized coating also protects the plastic wrapping material from being cut due to the weight of the product 106.

It should also be appreciated that the support 108, 110 may be provided with additional structure or arms to allow the supports 108, 110 to accommodate stacks of the product 106, such as standing seam roofing products.

The bottom side 118 of the support 108, 110 may also have at least one freely rotating wheel 122. The freely rotating wheel 122 may be guided by the track 112, 114, and thereby permit the remainder the support 108, 110 to be rolled along the track 112, 114, for example, when pushed by another of the supports 108, 110 or the moving wrapper unit 104. The freely rotating wheel 122 may be a substantially circular body rotatably disposed on an axle connected to a main body of the support 108, 110, for example. The wheel 122 may also have a groove or grooves that cooperate with a raised portion of the track 112, 114. A skilled artisan may select other suitable types of freely rotating wheels 122, as desired.

The apparatus 100 of the present disclosure further includes the wrapper unit 104, illustrated in FIGS. 1-8. The wrapper unit 104 is disposed on the track 112, 114, and is selectively movable toward the first end 113 and the second end 115 of the track 112, 114. The wrapper unit 104 can be moved independently of the supports 108, 110, for example, and causes the supports 108, 110 to move when the wrapper unit 104 contacts or otherwise pushes or pulls the supports 108, 110 as further described herein. Additionally, the wrapper unit 104 is configured for both the stretch wrapping of the product 106, as the wrapper unit 104 moves toward the first end 113 of the track 112, 114, and an advancing the product 106 toward the second end 115 of the track 112, 114, as the wrapper unit 104 moves toward the second end 115 of the track 112, 114.

As shown in FIGS. 1-5, the wrapper unit 104 is positioned between each of a plurality of connected pairs of supports 108, 110 of the product support unit 102. Each connected pair of supports 108, 110 includes a first support 108 and a second support 110. The first support 108 and the second support 110 are spaced apart along the track 112, 114. The first support 108 and the second support 110 are connected by at least one horizontal rail 124. The at least one horizontal rail 124 extends from the first support 108 to the second support 110, and is disposed beneath the wrapper unit 104.

As the wrapper unit 104 moves toward the first end 113 or the second end 115 of the product support unit 102, the wrapper unit 104 straddles the at least one horizontal rail 124. In the illustrated embodiments, the first support 108 of the connected pair of supports 108, 110 is disposed between the wrapper unit 104 and the first end 113 of the track 112, 114. The second support 110 is disposed between the wrapper unit 104 and the second end 115 of the track 112, 114. It should be appreciated that the first support 108 and the second support 110 of the connected pair of supports 108, 110, due to be free rolling in, on, or about the track 112, 114, move in tandem as the one of the first support 108 and the second support 110 is caused to move by the wrapper unit 104 toward one of the first end 113 and the second end 115 of the track 112, 114.

Figure 2:
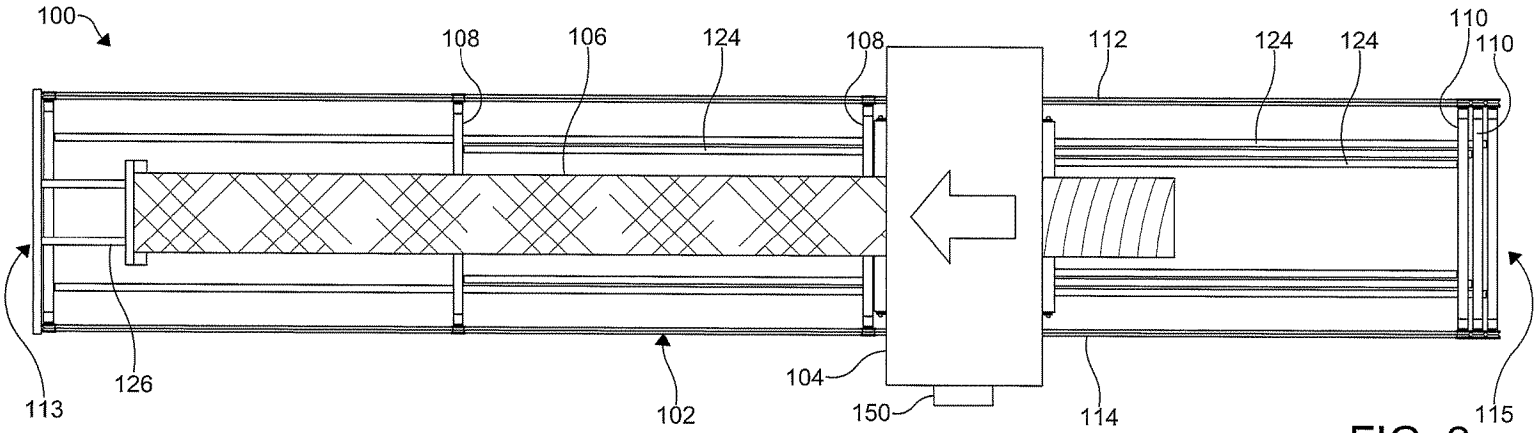

During a wrapping operation, as shown sequentially in FIGS. 1-5, the wrapper unit 104 may move toward the first end 113 of the track 112, 114 while wrapping the product 106, and will contact the free rolling first support 108 (shown in FIG. 2). This causes the first support 108 to move toward the first end 113 of the track 112, 114. Since the free rolling first support 108 is connected by the at least one rail 124 to the free rolling second support 110 on the other side of the wrapper unit 104, the second support 110 likewise is caused to move toward the first end 113 of the track 112, 114 (shown in FIG. 3).

Figure 3:
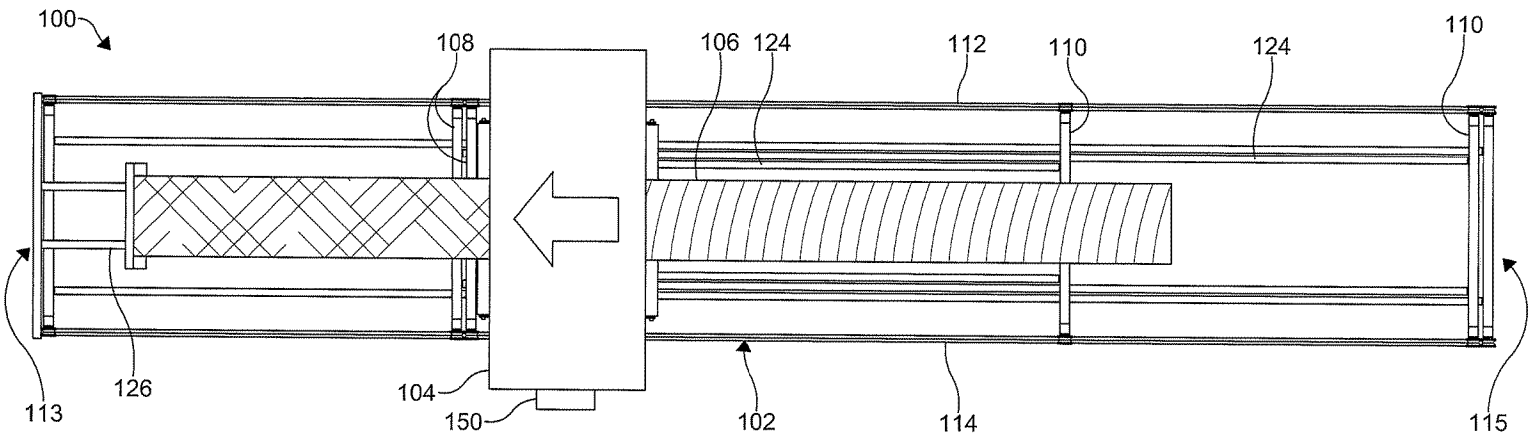
Figure 4:
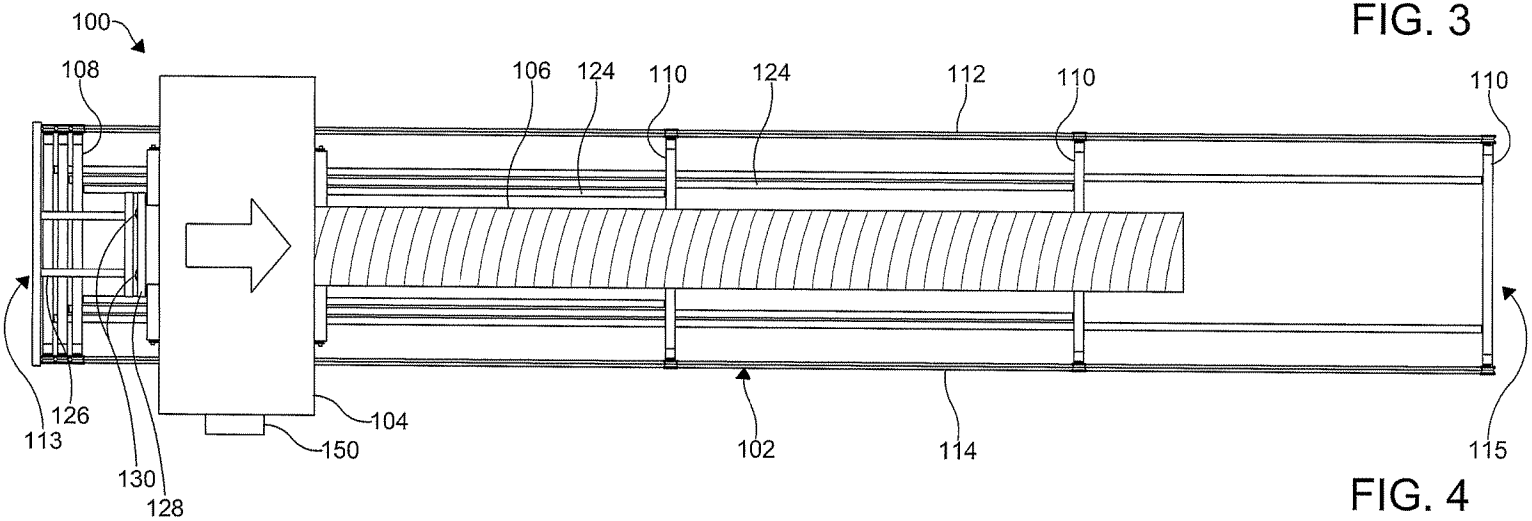
Figure 5:
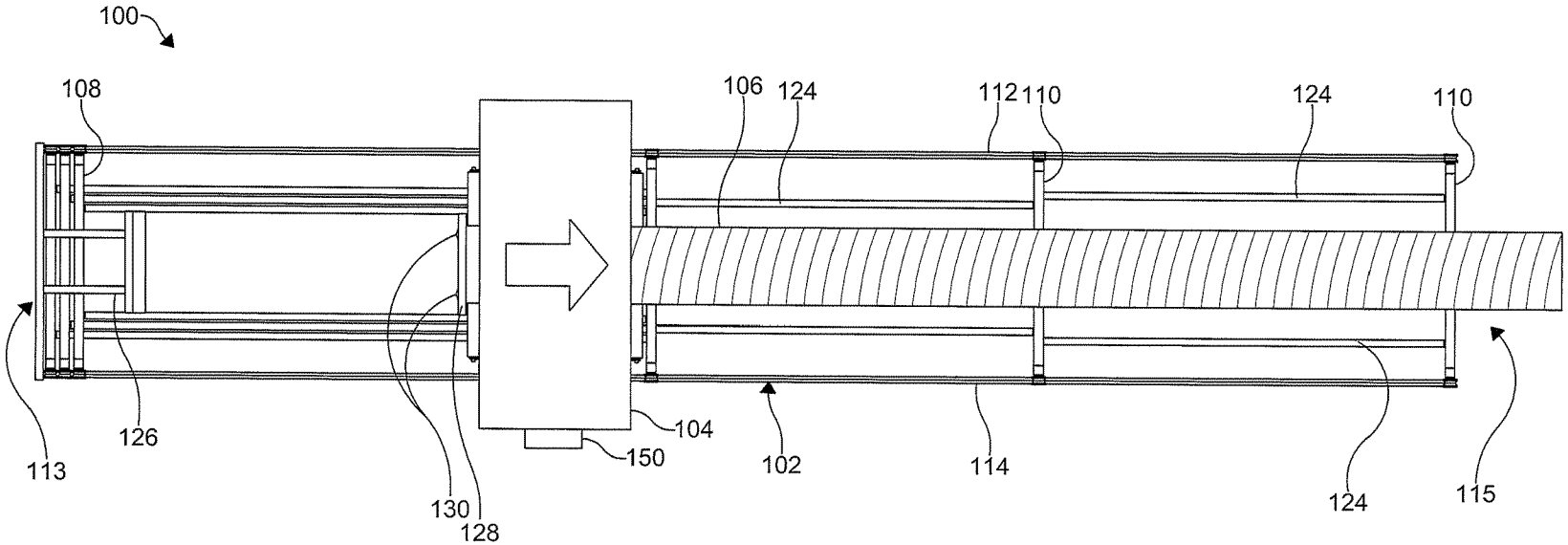

As also shown in FIG. 3, the first support 108 may further contact another first support 108 of another connected pair of supports 108, 110, which in turn causes the another connected pair of supports 108, 110 to also move toward the first end 113 of the track 112, 114 (shown in FIG. 4). The product 106 thereby remains fully supported by the supports 108, 110 of the product support unit 102 during the entire wrapping operation.

In order to maintain the product 106 in a substantially stationary position during the wrapping operation, the product support unit 102 further has a stationary product stop 126. The stationary product stop 126 may be substantially L-shaped in cross-section, and also configured to receive and support an end of the product 106. The stationary product stop 126 is disposed adjacent the first end 113 of the track 112, 114, and is generally positioned above the supports 108, 110. As the supports 108, 110 are caused to move toward the first end 113 of the track 112, 114, at least some of the supports 108, 110 may roll underneath the stationary product stop 126. Other shapes for the stationary product stop 126 are also contemplated and within the scope of the present disclosure.

In the wrapping operation, the wrapper unit 104 moves toward the first end 113 and likewise pushes the product 106 toward the first end 113 while wrapping the product 106. The stationary product stop 126 abuts the product 106, and militates against a movement of the product 106 toward the first end 113, which would otherwise undesirably push the product 106 off of the product support unit 102 during the stretch wrapping of the product 106 by the wrapper unit 104.

The wrapper unit 104 of the present disclosure also may have a removable product stop 128. The removable product stop 128 allows the wrapper unit 104 to advance the product 106 toward the second end 115 of the track 112, 114 of the product support unit 102 after the wrapping operation, for purposes of removing the wrapped product 106 from the apparatus 100. For example, the removable product stop 128 may be formed by a block-and-rod assembly that may be removably inserted into at least one holder 130 disposed in or on a side of the wrapper unit 104. Other suitable means for removably securing the removable product stop 128 to the wrapper unit 104, such as screws, bolts, or other fasteners, may also be employed within the scope of the disclosure. One of ordinary skill in the art may also select suitable structures and designs for each of the stationary product stop 126 of the product support unit 102 and the removable product stop 128 of the wrapper unit 104, as desired.

During the wrapping operation, the removable product stop 128 is removed from the wrapper unit 104. This permits the product 106 to abut the stationary product stop 126 of the product support unit 102. After the wrapping operation, and as depicted sequentially in FIGS. 4-5, the removable product stop 128 is attached to the wrapping unit 104 and abuts the product 106 instead of the stationary product stop 126. The abutting of the product 106 by the removable product stop 128 of the wrapping unit 104 allows the wrapping unit 104 to advance the wrapped product 106 toward the second end 115 of the track 112, 114 as the wrapping unit 104 also moves toward the second end 115 of the track 112, 114. The wrapped product 106 may then be unloaded from the apparatus 100.

Figure 6:
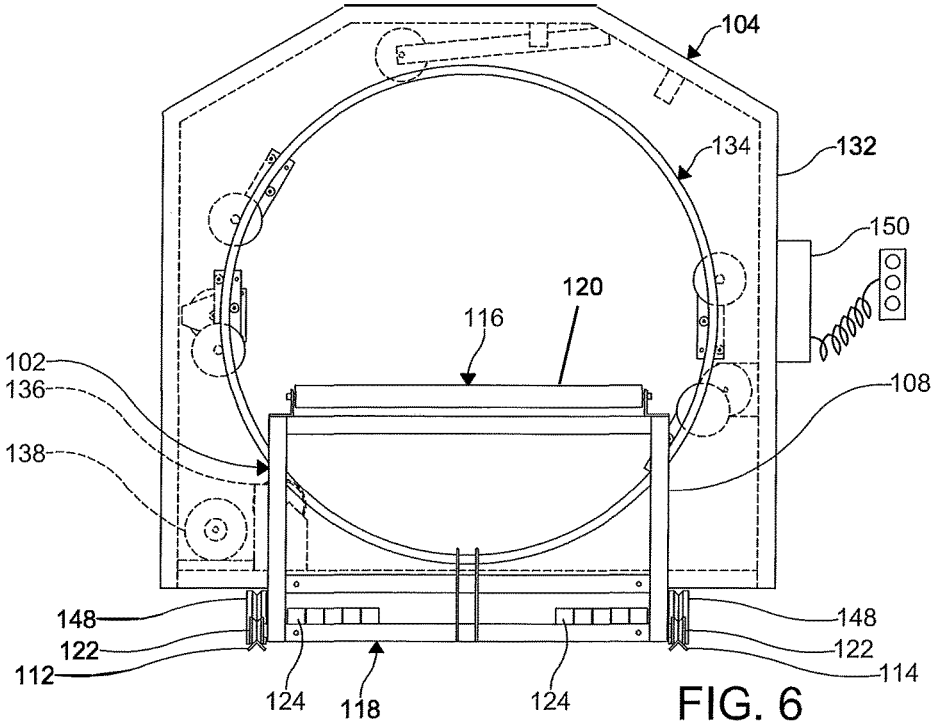
FIG. 6 is a front elevational view of a product support unit and a wrapper unit for the full motion wrapping apparatus shown in FIGS. 1-5, the wrapper unit independently movable on a pair of tracks of the product support unit, and with motors and other structure inside the wrapper unit shown in dashed lines.
Figure 7:
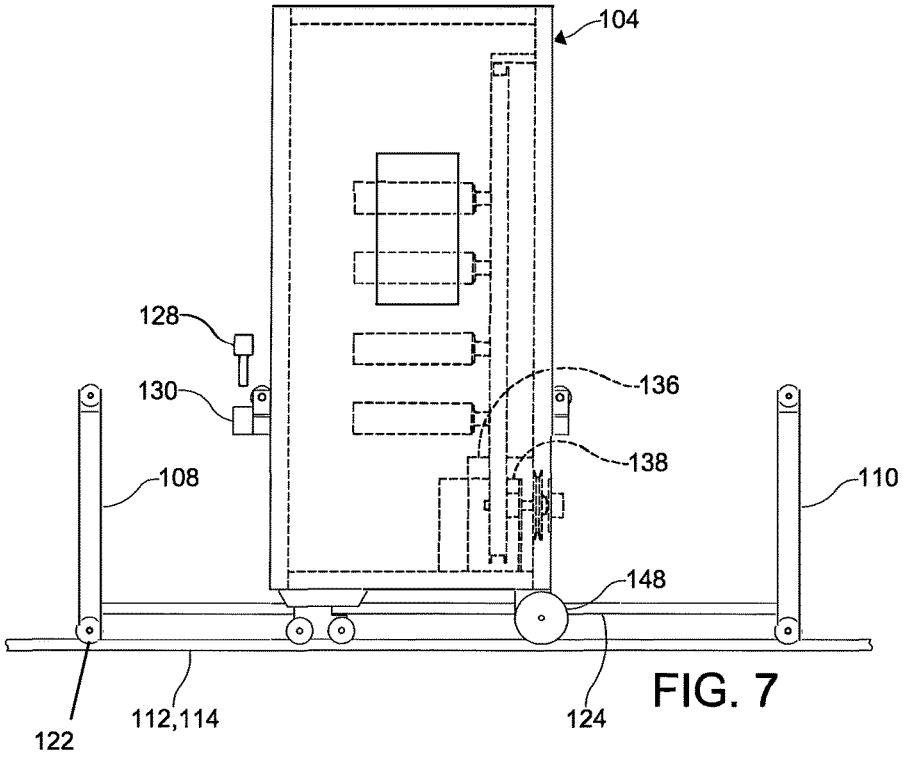
FIG. 7 is a side elevational view of the product support unit and the wrapper unit of the full motion wrapping apparatus shown in FIG. 6.

Referring now to FIGS. 6-7, the wrapping unit 104 according to one embodiment of the disclosure is further shown. The wrapping unit 104 may have a housing 132, an orbiter 134, a first motor 136, and a second motor 138. The orbiter 134 may be disposed inside the housing 132. The first motor 136 is configured for rotating the orbiter 134, and can be disposed inside or outside of the housing 132, as desired. The second motor 138 is configured for moving the wrapper unit 104 along the track 112, 114. Like the first motor 136, the second motor 138 may be disposed inside or outside of the housing 132, as desired. Any type of motor, including electric, pneumatic, and hydraulic motors, may be used for each of the first motor 136 and the second motor 138 within the scope of the present disclosure.

As shown in FIG. 8, the orbiter includes at least two cylinders 140, 142. The at least two cylinders 140, 142 are advantageously mounted on opposing sides of a rotatable ring 144, so as to counterbalance each other and militate against the product 106 being pulled from the product support unit 102 during the wrapping operation. The cylinders 140, 142 are configured to receive rolls of wrapping material 146 for the stretch wrapping of the product 106.

The wrapping material 146 may include a thin plastic or polymer film that has a tendency to cling to itself, as well to the product 106. For example, the wrapping material 146 may be formed from polyethylene film. The wrapping material 146 may also be substantially transparent, so as to permit one to view the condition of the product 106 following the wrapping operation. In other examples, the wrapping material 146 may be opaque white, colored, or translucent. One of ordinary skill in the art may select other suitable types of the wrapping material 146, as desired.

With renewed reference to FIGS. 6-7, it should be understood that the wrapper unit 104 has at least one drive wheel 148 configured to move the wrapper unit 104 along the track 112, 114. The drive wheel 148 may contact the track 112, 114 and support the housing 132 of the wrapper unit 104, for example. The housing 132 may also have other wheels, either driven or free rolling, for support of the housing 132 adjacent the track 112, 114. In particular embodiments, the second motor 138 is connected to the drive wheel 148 and selectively causes the wrapper unit 104 to move either forward, toward the first end 113 of the track 112, 114, or backward toward the second end 115 of the track 112, 114. The second motor 138 may be directly connected to the drive wheel 148, or indirectly connected through at least one of a drive train, chain linkage, and gear assembly, for causing a rotational movement of the drive wheel 148 or a movement of the housing 132 of the wrapper unit 104, as desired.

The housing 132 of the wrapper unit 104 may further have a controller 150. The controller 150 may include one of a mechanical controller and a computer-based or programmable logic controller (PLC) for controlling each of the first motor 136 and the second motor 138. The controller 150 is in communication with each of the first motor 136 and the second motor 138, and is configured to control both an actuation of the first motor 136 and the second motor 138, and a direction of rotation imparted to each of the orbiter 134 and the drive wheel 148 of the wrapper unit 104.

Figure 10:
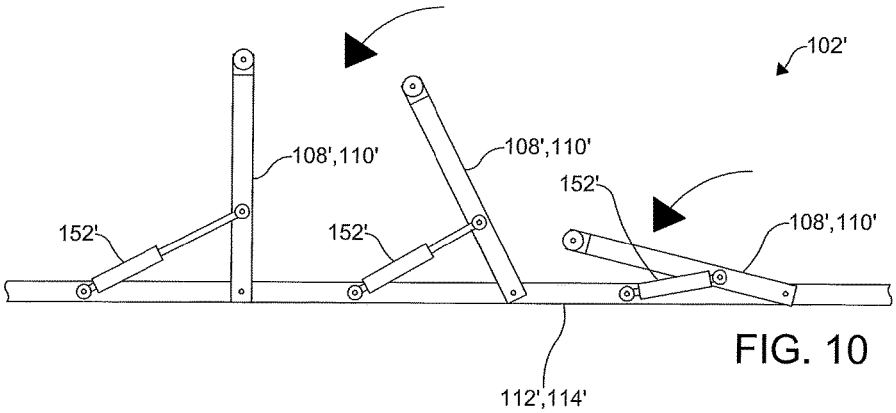
FIG. 10 is a fragmentary side elevational view of a product support unit for the full motion wrapping apparatus according to another embodiment of the present disclosure, showing by the arrows a selective downward pivoting of individual product supports on the track to facilitate movement of the wrapper unit on the same track.
Figure 11:
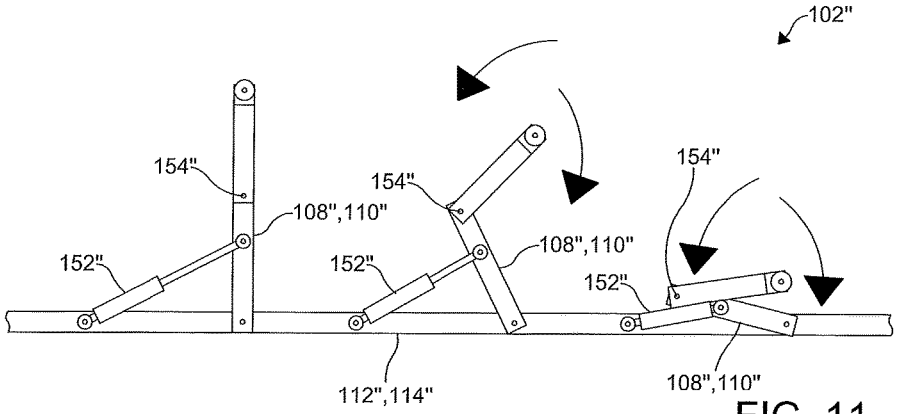
FIG. 11 is a fragmentary side elevational view of a product support unit for the full motion wrapping apparatus according to a further embodiment of the present disclosure, showing by the arrows a selective downward pivoting and a hinged collapsing of individual product supports on the track to facilitate movement of the wrapper unit on the same track.

Although the product support unit 102 is described hereinabove as primarily having supports 108, 110 that move relative to each other along the track 112, 114, other means for permitting the wrapper unit 104 to move along the track 112, 114 while still supporting the product 106 are also contemplated. FIGS. 10 and 11 show these alternative embodiments, with like or similar structure to that shown in FIGS. 1-9 identified with a prime symbol (') or a double-prime symbol (") for purpose of clarity.

In FIG. 10, an alternative embodiment of the product support unit 102' is depicted, in which each of the supports 108', 110' is pivotally connected to the track 112', 114'. Each of the supports 108', 110' is also connected to at least one actuator 152'. The actuator 152' may include any suitable type of motor, piston, or cylinder, including electric, pneumatic or hydraulic, that may selectively pivot the supports 108', 110'. In particular, the actuator 152' is configured to selectively pivot the support 108', 110' from a position for supporting the product 106 to a position permitting the wrapper unit 104 to move over the support 108', 110'. For example, the actuator 152' may be in communication with the controller 150, which can be configured to pivot the supports 108', 110' downwardly as the wrapper unit 104 approaches the supports 108', 110'. Likewise, the actuator 152' is configured to pivot the supports 108', 110' upwardly to support the product 106 as needed.

In FIG. 11, each of the supports 108", 110" is further shown with an additional hinge 154". The additional hinge 154" allows the support 108", 110" to further collapse in the position permitting the wrapper unit 104 to move over the support 108", 110" when pivoted downwardly by the actuator 152". Additional gears, linkages, cylinders, or motors may also be employed to facilitate the collapsing of the supports 108", 110", as desired.

Figure 12:
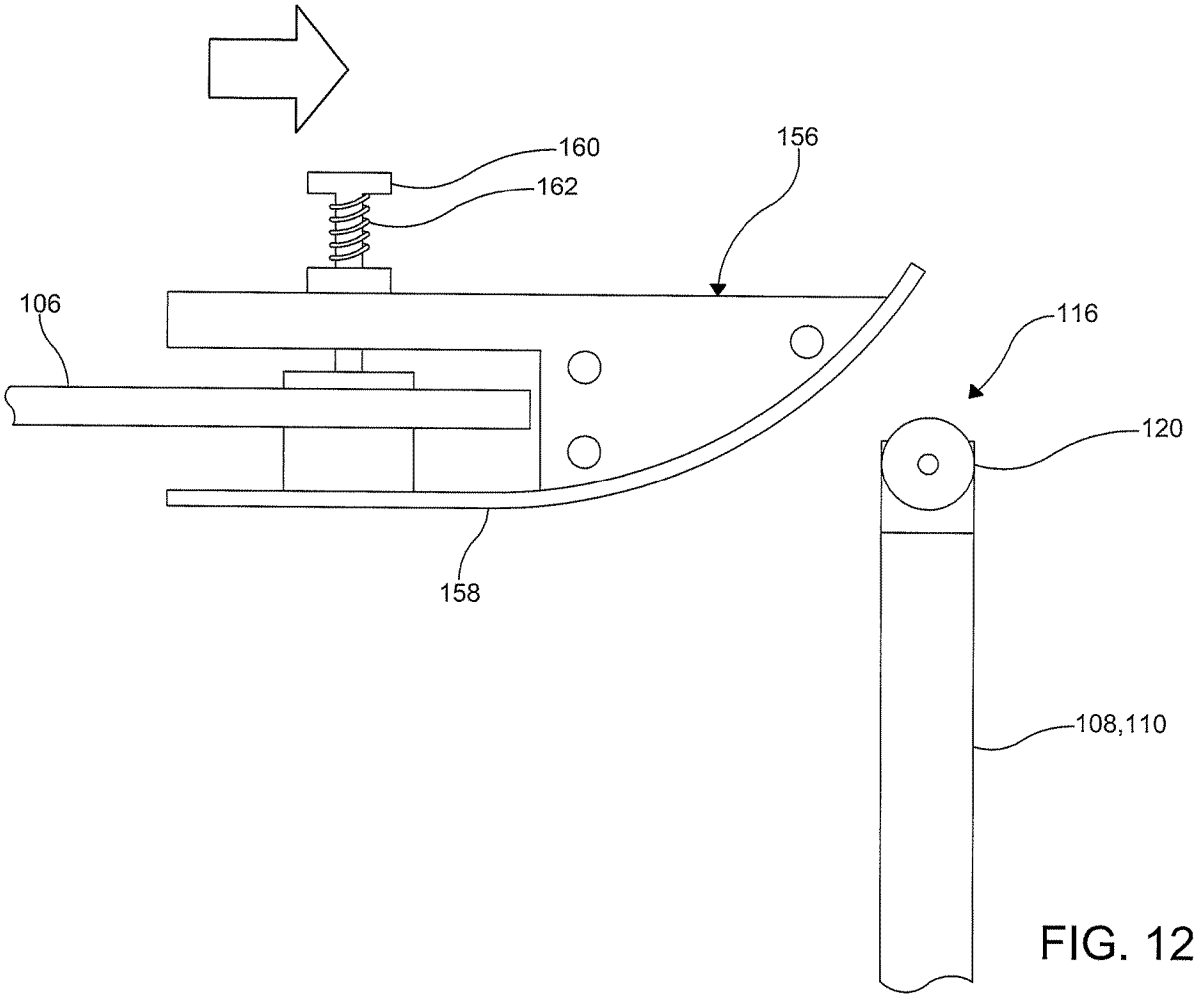
FIG. 12 is a fragmentary side elevational view of a ski clamp for use with the product support unit for the full motion wrapping apparatus of the present disclosure.

Referring now to FIG. 12, a ski clamp 156 for use with the product support unit 102 of the present disclosure is also shown. During the wrapping process, the ski clamp 156 is attached to the wrapped end of the product 106 after it exits the wrapper unit 104. Upon advancing the wrapped product 106 by the wrapper unit 104 toward the second end 115 of the track 112, 114, the ski clamp 156 militates against the wrapped end of the product 106 crashing into the supports 108, 110. The ski clamp 156 instead causes the wrapped end to ski atop the rollers 120, thereby minimizing an opportunity for damage to both the product support unit 102 and the product 106.

In a particular embodiment, the ski clamp 156 has an arcuate ski 158 attached to a main body. The arcuate ski 158 and main body are selectively clamped to the wrapped end of the product 106 by a clamping mechanism 160. The clamping mechanism 160 may have a spring 162 that applies a spring force to hold the ski clamp 156 in place. The clamping mechanism 160 and spring 162 also facilitates the clamping of the ski 158 to stacks of product 106 having different thicknesses or heights. One of ordinary skill in the art may also select other suitable structures for the ski clamp 156, as desired.

The full motion wrapping apparatus 100 of the present disclosure advantageously wraps the product 106 by horizontal movement of the wrapper unit 104, as opposed to moving the product 106 itself. This provides the benefit that the product 106 does not need extra space to move while being wrapped. This frees up valuable space in the facility in which the full motion wrapping apparatus 100 is installed. Another advantage of the full motion wrapping apparatus 100 is that only one person is needed to operate it. This results in significant labor savings, as only one employee is needed to prepare the product 106 for shipment, no matter the length or quantity of the product 106. Furthermore, the full motion wrapping apparatus 100 protects the product 106 by wrapping it with the wrapping material, such as plastic wrap. This provides protection to the underlying wrapped product 106, which otherwise might be scratched or damaged when transported for sale and ultimate use.

With respect to packaging of metal sheets as the product 106, prior art packaging has involved the use of metal cover sheets, steel banding, and lumber. The average small roll forming company uses approximately 250 feet of cover sheets, 500 feet of steel banding, and 50 piece of lumber per day for packaging. The full motion wrapping apparatus 100 of the present disclosure replaces these various materials with wrapping material such as shrink- or plastic-wrap, resulting in a more efficient and rapid packaging of metal sheet products 106.

While certain representative embodiments and details have been shown for purposes of illustrating the invention, it will be apparent to those skilled in the art that various changes may be made without departing from the scope of the disclosure, which is further described in the following appended claims.

What is claimed is:

1. A full motion wrapping apparatus, comprising:

a product support unit including a plurality of supports and a track, the supports disposed adjacent to the track, the track having a first end and a second end, the product support unit configured to support and maintain a product in a substantially stationary position during a stretch wrapping of the product, each of the supports having a top side and a bottom side, the top side having a roller for receiving the product, the roller oriented transverse to an orientation of the track, and the bottom side having a freely rotating wheel guided by the track;

a stationary product stop connected to the product support unit adjacent to the first end of the track and positioned above the supports;

a wrapper unit disposed on the track and selectively movable toward the first end and the second end of the track; and a removable product stop removably connected to a side of the wrapper unit, wherein the wrapper unit is configured for the stretch wrapping of the product and the stationary product stop is configured for abutting the product to militate against a movement of the product toward the first end of the track as the wrapper unit moves toward the first end of the track, and the wrapper unit is configured for advancing the product toward the second end of the track and the removable product stop is configured for abutting the product to cause the advancement of the product toward the second end of the track as the wrapper unit moves toward the second end of the track.

2. The full motion wrapping apparatus of claim 1, wherein the wrapper unit is disposed between a connected pair of the supports, the connected pair of the supports including a first support and a second support, the first support spaced apart from the second support along the track.

3. The full motion wrapping apparatus of claim 2, wherein the first support and the second support are connected by at least one horizontal rail disposed beneath the wrapper unit.

4. The full motion wrapping apparatus of claim 3, wherein the first support is disposed between the wrapper unit and the first end of the track, and the second support is disposed between the wrapper unit and the second end of the track.

5. The full motion wrapping apparatus of claim 1, wherein the wrapper unit includes a housing with an orbiter, a first motor for rotating the orbiter, and a second motor for moving the wrapper unit on the track.

6. The full motion wrapping apparatus of claim 5, wherein the orbiter is disposed within the housing of the wrapper unit.

7. The full motion wrapping apparatus of claim 6, wherein the orbiter includes at least two cylinders mounted on opposing sides of a rotatable ring, the cylinders configured to receive rolls of wrapping material for the stretch wrapping of the product.

8. The full motion wrapping apparatus of claim 5, wherein the wrapper unit has at least one drive wheel that contacts the track and supports the housing.

9. The full motion wrapping apparatus of claim 8, wherein the second motor is connected to the drive wheel and selectively causes the wrapper unit to move forward toward the first end of the track and backward toward the second end of the track.

10. The full motion wrapping apparatus of claim 5, wherein the housing of the wrapper unit has a controller in communication with each of the first motor and the second motor.

11. The full motion wrapping apparatus of claim 1, wherein each of the supports of the product support unit is pivotally connected to the track.

12. The full motion wrapping apparatus of claim 1, wherein the removable product stop includes a block-and-rod assembly that is removably inserted into at least one holder disposed in or on a side of the wrapper unit.

* * * * *